US011472627B2

(12) United States Patent
Tanaka et al.

(10) Patent No.: US 11,472,627 B2
(45) Date of Patent: Oct. 18, 2022

(54) PACKAGING BOX FOR ROLL-SHAPED MATERIAL

(71) Applicant: SEIKO EPSON CORPORATION, Tokyo (JP)

(72) Inventors: Reina Tanaka, Matsumoto (JP); Masahiro Akamine, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 44 days.

(21) Appl. No.: 17/001,238

(22) Filed: Aug. 24, 2020

(65) Prior Publication Data

US 2021/0061545 A1 Mar. 4, 2021

(30) Foreign Application Priority Data

Aug. 26, 2019 (JP) ..... JP2019-154071

(51) Int. Cl.
*B65D 85/66* (2006.01)
*B65D 5/50* (2006.01)
*B65D 85/02* (2006.01)

(52) U.S. Cl.
CPC ..... *B65D 85/66* (2013.01); *B65D 5/5004* (2013.01); *B65D 85/02* (2013.01)

(58) Field of Classification Search
CPC ..... B65D 5/50; B65D 5/5004; B65D 85/02; B65D 85/04; B65D 85/66; B65D 85/672; B65D 85/67; B25H 49/08; B25H 55/04; B25H 55/046; B25H 57/12
USPC ..... 206/396, 397, 408, 409; 242/171
See application file for complete search history.

(56) References Cited

U.S. PATENT DOCUMENTS 2,860,773 A * 11/1958 Zackheim ..... B65D 5/5097 206/394
3,228,519 A * 1/1966 Dong ..... B65D 85/672 206/408
3,229,812 A * 1/1966 Metzger ..... B65D 85/672 206/396
4,019,636 A * 4/1977 Wise ..... B65D 5/5004 206/396
4,671,409 A * 6/1987 Espy ..... B65D 85/672 206/397
4,817,796 A * 4/1989 Camillo ..... B65D 5/5004 206/395
5,150,789 A * 9/1992 Bass ..... B65D 5/5004 206/396

(Continued)

FOREIGN PATENT DOCUMENTS

JP 2001-180657 7/2001

*Primary Examiner* — Bryon P Gehman
(74) *Attorney, Agent, or Firm* — Workman Nydegger

(57) ABSTRACT

A packaging box for a roll-shaped material wound around a cylindrical core, including a prism-shaped case body, and respective side surface portions at both ends in a longitudinal direction of the prism-shaped case body, the prism-shaped case body and the side surface portions being formed of a single sheet member, that includes a holding unit inserted into the cylindrical core of the roll-shaped material to hold the roll-shaped material within the prism-shaped case body, wherein, when the holding unit is inserted into the cylindrical core of the roll-shaped material, a region facing an end portion of the cylindrical core in a cross direction intersecting the longitudinal direction in which the prism-shaped case body extends, is formed with a recessed portion that is recessed in the cross direction.

13 Claims, 7 Drawing Sheets

(56) References Cited

U.S. PATENT DOCUMENTS

| | | | | |
|---|---|---|---|---|
| 5,310,058 | A * | 5/1994 | Hannen | B65D 85/672 206/396 |
| 6,742,690 | B2 * | 6/2004 | Gerulski | B65D 83/0805 206/396 |
| 6,991,098 | B2 * | 1/2006 | Silverbrook | B65D 85/672 206/397 |
| 7,201,272 | B2 * | 4/2007 | Silverbrook | B41J 2/17553 206/397 |
| 7,419,053 | B2 * | 9/2008 | Silverbrook | B41J 2/14427 206/397 |
| 8,596,455 | B2 * | 12/2013 | Babcock | B65H 55/046 206/395 |

* cited by examiner

PACKAGING BOX FOR ROLL-SHAPED MATERIAL

The present application is based on, and claims priority from JP Application Serial Number 2019-154071, filed Aug. 26, 2019, the disclosure of which is hereby incorporated by reference herein in its entirety.

BACKGROUND

1. Technical Field

The present disclosure relates to a packaging box for a roll-shaped material.

2. Related Art

In the past, various packaging boxes for roll-shaped materials have been used. A roll-shaped material is provided with a cylindrical core, and a packaging box for the roll-shaped material is provided with a prism-shaped case body and side surface portions that seal both side surfaces of the prism-shaped case body respectively, however, the packaging box for the roll-shaped material, in order to suppress damage to the roll-shaped material, fixes the cylindrical core inside the prism-shaped case body to hold the roll-shaped material in a non-contact manner. A configuration for bringing the roll-shaped material into the non-contact state inside the prism-shaped case body of the packaging box is generally a configuration in which suspending members each having an insertion portion into the cylindrical core, and a flange portion, are attached to both end portions of the cylindrical core respectively to accommodate the roll-shaped material inside the prism-shaped case body. Additionally, JP-A-2001-180657, as a configuration in which a roll-shaped material is brought into a non-contact state inside a prism-shaped case body of a packaging box, discloses a configuration in which a holding unit is provided that is integrally formed with the packaging box and is inserted into a cylindrical core so as to hold the roll-shaped material within the prism-shaped case body.

However, in general, the cylindrical core was made of paper, and in the configuration in the past in which the roll-shaped material was brought into the non-contact state inside the prism-shaped case body of the packaging box, an end portion of the cylindrical core and an insert inserted into the cylindrical core were rubbed with each other in association with movement of the packaging box accommodating the roll-shaped material, and the like, and thus the end portion of the cylindrical core, or a protective portion such as a plastic film sheet or the like for protecting the end portion of the cylindrical core along with the roll-shaped material, or the like, were scraped, and shavings such as paper powder were generated in some cases. For example, there is a case in which, with shavings of a cylindrical core attached to a roll-shaped material, printing is performed onto the roll-shaped material using an ink jet printer or the like, the shavings may enter a discharge portion of ink, or the like, leading to printing defects in some cases. Thus, there is a demand for a packaging box that holds a roll-shaped material without damaging a cylindrical core.

SUMMARY

A packaging box for a roll-shaped material of the present disclosure for solving the problems described above is a packaging box for a roll-shaped material wound around a cylindrical core, including a prism-shaped case body, and side surface portions for sealing both side surfaces of the prism-shaped case body respectively, the prism-shaped case body and the side surface portion being formed of a single sheet member, that includes a holding unit inserted into the cylindrical core of the roll-shaped material to hold the roll-shaped material within the prism-shaped case body, wherein, when the holding unit is inserted into the cylindrical core of the roll-shaped material, a region facing an end portion of the cylindrical core in a cross direction intersecting the longitudinal direction in which the prism-shaped case body extends, is formed with a recessed portion that is recessed in the cross direction.

DESCRIPTION OF EXEMPLARY EMBODIMENTS

Figure 1:
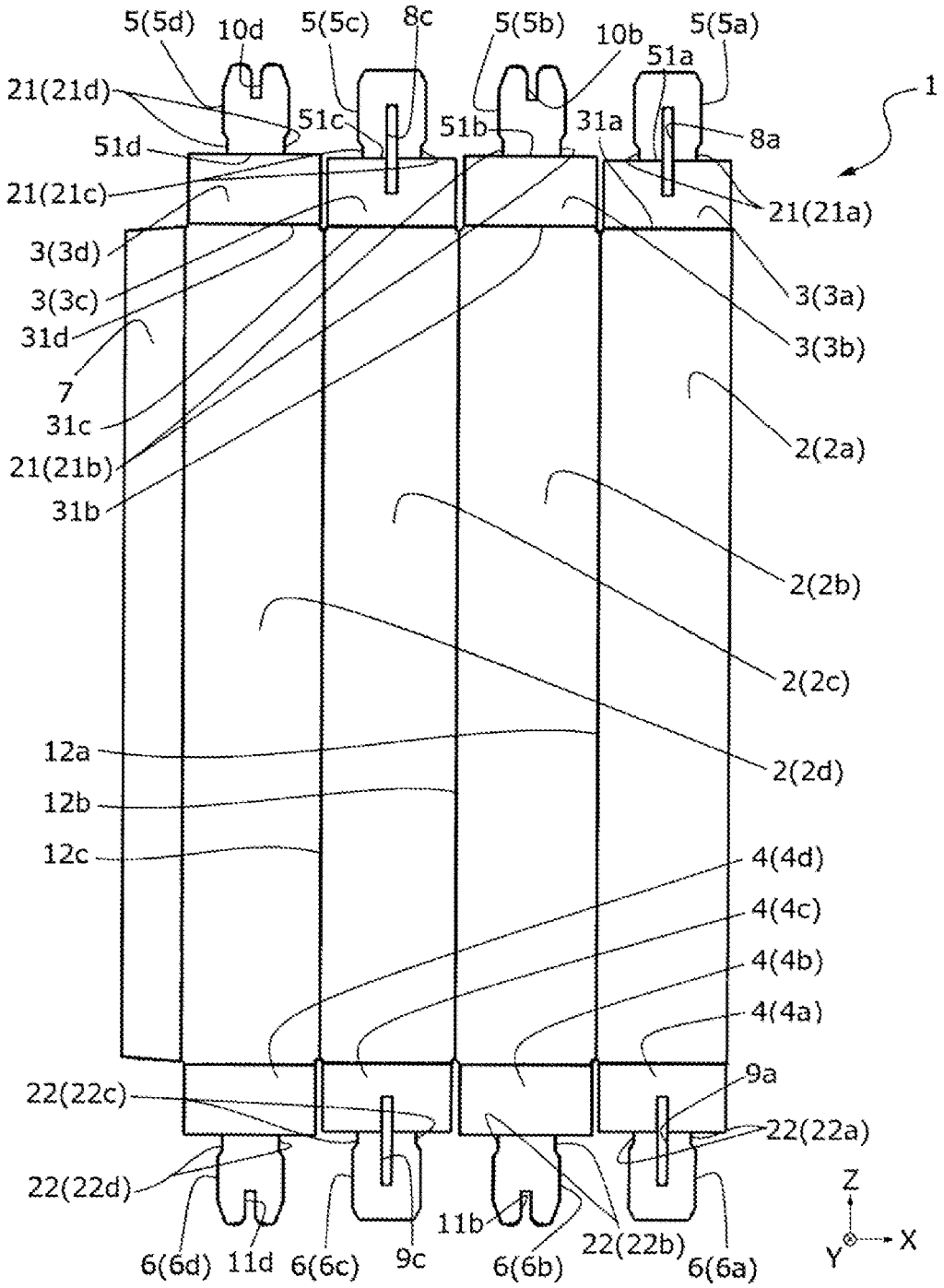
FIG. 1 is a developed view of a packaging box for a roll-shaped material according to Example 1 of the present disclosure.

First, the present disclosure will be schematically described.

A packaging box for a roll-shaped material according to a first aspect of the present disclosure for solving the problems described above is, a packaging box for a roll-shaped material wound around a cylindrical core, including a prism-shaped case body, and respective side surface portions at both ends in a longitudinal direction of the prism-shaped case body, the prism-shaped case body and the side surface portion being formed of a single sheet member, that includes a holding unit inserted into the cylindrical core of the roll-shaped material to hold the roll-shaped material within the prism-shaped case body, wherein, when the holding unit is inserted into the cylindrical core of the roll-shaped material, a region facing an end portion of the cylindrical core in a cross direction intersecting the longitudinal direction in which the prism-shaped case body extends, is formed with a recessed portion that is recessed in the cross direction.

According to the present aspect, the region of the holding unit facing the end portion of the cylindrical core in the cross direction when inserted into the cylindrical core, is formed with the recessed portion that is recessed in the cross direction. Accordingly, rubbing between the end portion of the cylindrical core and the holding unit can be suppressed, and the roll-shaped material can be held without the cylindrical core damaged.

In a packaging box for a roll-shaped material according to a second aspect of the present disclosure, the holding unit in the first aspect is integrally formed with the side surface portions by the single sheet member.

According to the present aspect, since the holding unit is integrally formed with the side surface portions by the single sheet member, it is possible to hold the roll-shaped material without separately preparing a holding unit, and without damaging the cylindrical core.

In a packaging box for a roll-shaped material according to a third aspect of the present disclosure, the prism-shaped case body in the second aspect, is a rectangular parallelepiped, the holding unit is formed by folding a first surface pair and a second surface pair, that are end portions of the prism-shaped case body and each include opposing two surfaces of the prism-shaped case body inward the prism-shaped case body in order of the first surface pair and the second surface pair, and a length of the recessed portion in the longitudinal direction in the second surface pair is larger than a length of the recessed portion in the longitudinal direction in the first surface pair.

According to the present aspect, the rectangular parallelepiped is used for the prism-shaped case body, thus stability when placed on a flat surface is improved. Additionally, by configuring the holding unit with the first surface pair and the second surface pair, the holding unit can be configured to be simple and robust. Furthermore, by making the length of the recessed portion in the longitudinal direction in the second surface pair larger than the length of the recessed portion in the longitudinal direction in the first surface pair, the recessed portion in the second surface pair can have a shape in consideration of a thickness of the sheet member corresponding to the folded portion configuring the first surface pair. That is, contact between the second surface pair and the end portion of the cylindrical core, caused by the length of the recessed portion in the longitudinal direction in the second surface pair becoming insufficient, caused by an increase in the thickness of the sheet member corresponding to the folded portion configuring the first surface pair, can be suppressed.

In a packaging box for a roll-shaped material according to a fourth aspect of the present disclosure, the holding unit in the first aspect is formed as a different body from the single sheet member.

According to the present aspect, since the holding unit is formed as the different body from the sheet member, the holding unit and the sheet member can each be formed of an optimal material.

In a packaging box for a roll-shaped material according to a fifth aspect of the disclosure, the recessed portion according to any one of the first to fourth aspects, is formed by combining a straight line portion and an arc portion.

According to the present aspect, the recessed portion is formed by combining the straight line portion and the arc portion. When the recessed portion is formed by only a straight line portion, strength may decrease at a corner portion where the straight line portion intersects or the like, and when the recessed portion is formed by only an arc portion, adjustments of a recessed amount of the recessed portion may be difficult, but by combining the straight line portion and the arc portion to form the recessed portion, such adverse effects can be suppressed.

In a packaging box for a roll-shaped material according to a sixth aspect of the present disclosure, the sheet member, in any one of the first to fifth aspects, is formed of cardboard or coated cardboard.

According to the present aspect, the prism-shaped case body and the side surface portions can be configured to be robust and lightweight. Also, for example, by forming the holding unit of cardboard or coated cardboard, the holding unit can also be configured to be robust and lightweight.

In a packaging box for a roll-shaped material according to a seventh aspect of the present disclosure, the length of the recessed portion in the longitudinal direction in any one of the first to sixth aspects, is equal to or less than 50 mm.

According to the present aspect, the length of the recessed portion in the longitudinal direction is equal to or less than 50 mm. When the length of the recessed portion in the longitudinal direction is too long, there is a possibility that strength of the holding unit decreases. By setting the length of the recessed portion in the longitudinal direction to be equal to or less than 50 mm, such an adverse effect can be suppressed.

Examples according to the present disclosure will be specifically described below with reference to the accompanying drawings.

Example 1

First, a packaging box 1 for a roll-shaped material of the present disclosure according to Example 1 will be described using FIG. 1 to FIG. 5. The packaging box 1 of the present example is formed of a single cardboard sheet, and side surface portions 3 and 4 that each seal a side surface of a prism-shaped case body 2, and holding units 5 and 6 that hold a cylindrical core 32 of a roll-shaped material 31 (see FIG. 6 and FIG. 7) are integrally formed. However, the present disclosure is not limited to the packaging box having such a configuration. The prism-shaped case body 2 could be formed into a circular cylindrical shape, a square cylindrical shape or a rectangular cylindrical shape. Note that, in each of the figures, a Z-axis direction is a longitudinal direction in which the prism-shaped case body 2 extends, and both an X-axis direction and a Y-axis direction are directions orthogonal to the Z-axis direction, and the respective directions are orthogonal to each other.

FIG. 1 is a developed view of the packaging box 1 of the present example. The developed view illustrates a state in which the packaging box is formed of a single cardboard sheet, and is punched by a punching machine. The packaging box 1 includes four pieces 2*a*, 2*b*, 2*c*, and 2*d* forming the cylindrical body 2 that is a rectangular parallelepiped, side flaps 3*a*, 3*b*, 3*c*, 3*d*, 4*a*, 4*b*, 4*c*, and 4*d* forming the side surface portions 3 and 4 that seal both the side surfaces of the cylindrical body 2 respectively, holding flaps 5*a*, 5*b*, 5*c*, 5*d*, 6*a*, 6*b*, 6*c*, and 6*d* forming the holding units 5 and 6 that hold the cylindrical core 32 of the roll-shaped material 31, and a bonding margin portion 7 for bonding the prism-shaped case body 2. Here, the side flaps 3*a*, 3*b*, 3*c*, 3*d*, 4*a*, 4*b*, 4*c*, and 4*d* forming the side surface portions 3 and 4, and the holding flaps 5*a*, 5*b*, 5*c*, 5*d*, 6*a*, 6*b*, 6*c*, and 6*d* forming the holding units 5 and 6 are integrally formed.

The side flap and the holding flap 3*a* and 5*a*, 3*c* and 5*c*, 4*a* and 6*a*, and 4*c* and 6*c* have punched portions 8*a*, 8*c*, 9*a*, and 9*c* of identical shape and size respectively, and the holding flaps 5*b*, 5*d*, 6*b* and 6*d* have cutout portions 10*b*, 10*d*, 11*b*, and 11*d* of identical shape and size respectively.

In addition, a recessed portion 21 is formed in each of the holding flaps 5*a*, 5*b*, 5*c*, and 5*d* that form the holding unit 5 that holds the cylindrical core 32 of the roll-shaped material 31, and a recessed portion 22 is formed in each of the holding flaps 6*a*, 6*b*, 6*c*, and 6*d* that form the holding unit 6 that holds the cylindrical core 32 of the roll-shaped material 31. The recessed portions 21 and 22 will be described in detail later.

Figure 2:
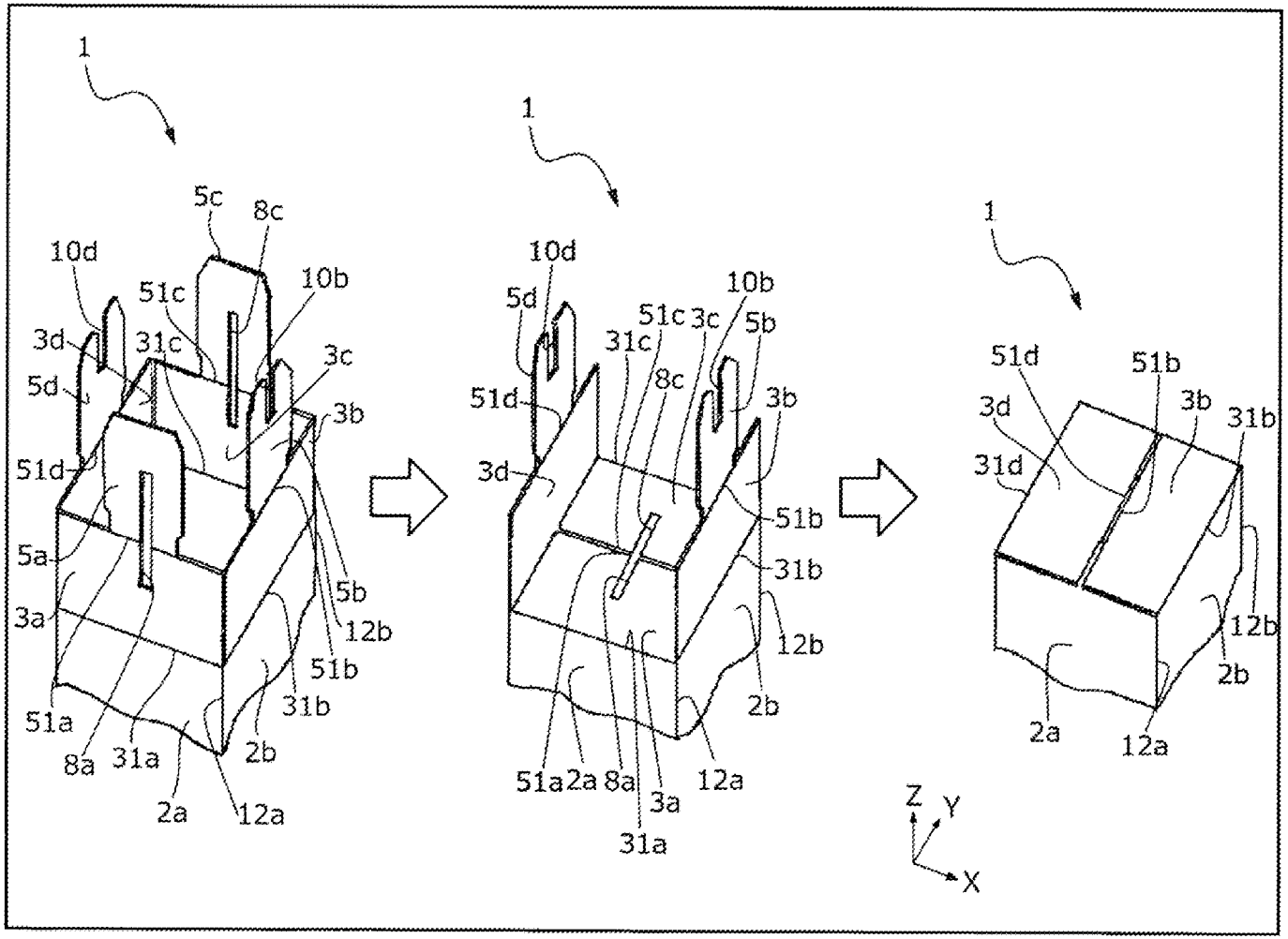
FIG. 2 is a perspective view for explaining an assembly procedure of a holding unit in the packaging box for the roll-shaped material according to Example 1 of the present disclosure.

Next, a procedure for assembling the developed view represented by FIG. 1 as the packaging box 1 will be described. FIG. 2 is an assembly explanatory diagram. First, folding is performed along ruled lines 12*a*, 12*b*, and 12*c* as folding lines to form the rectangular parallelepiped cylindrical body 2, and the bonding margin portion 7 is bonded to the piece 2*a* with an adhesive such that the bonding margin portion 7 is on an inside, thereby forming the prism-shaped case body 2 as illustrated in a diagram on a left side of FIG. 2. Next, as illustrated in a diagram at a center of FIG. 2, the side flaps 3*a*, 3*c* are folded along the folding lines 31*a*, 31*c*, respectively, and the holding flaps 5*a*, 5*c* are folded along the folding lines 51*a*, 51*c*, respectively. Here, the holding flaps 5*a* and 5*c* are brought into a state of being folded inward the box. Next, as illustrated in a diagram on a right side of FIG. 2, the side flap 3*d* and the holding flap 5*d* are folded along the folding lines 31*d* and 51*d*, respectively, and the holding flap 5*d* is inserted into the punched portions 8*a* and 8*c*. Likewise, the side flap 3*b* and the holding flap 5*b* are folded, and the holding flap 5*b* is inserted into the punched portions 8*a* and 8*c*. At this stage, one side surface of the prism-shaped case body 2 is brought into a state of being sealed.

Figure 3:
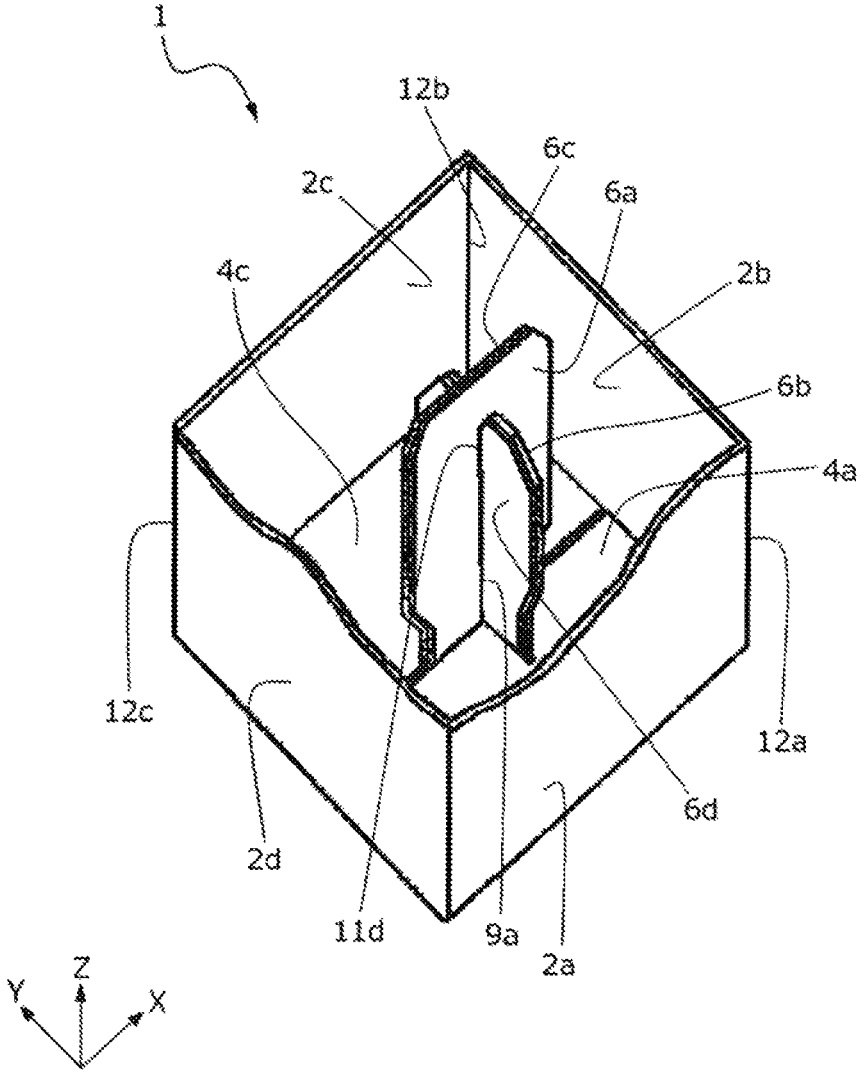
FIG. 3 is a perspective view of the holding unit for which the assembly is completed in the packaging box for the roll-shaped material according to Example 1 of the present disclosure.

FIG. 3 is a perspective view of the holding unit 6, when a state is viewed from an inside of the packaging box 1 in which another side surface of the prism-shaped case body 2 is sealed with respect to FIG. 2. The holding unit 6 is formed of four number of the holding flaps 6*a*, 6*b*, 6*c*, and 6*d*. Then, the holding flaps 6*b* and 6*d* are inserted into the punched portions 9*a* and 9*c* of the respective holding flaps 6*a* and 6*c*, and the holding flaps 6*a* and 6*c* are inserted into the cutout portions 11*b* and 11*d* of the respective holding flaps 6*b* and 6*d*, and are fitted and fixed to each other.

When the packaging box 1 of the present example is used to create a package for a roll-shaped material, first, one side surface of the prism-shaped case body 2 is sealed as illustrated in the diagram on the right side of FIG. 2 and FIG. 3, the roll-shaped material 31 is inserted from another open side surface of the prism-shaped case body 2 such that a hollow portion of the cylindrical core 32 of the roll-shaped body 31 is inserted with one of the holding units 5 and 6 formed as described above, and after the insertion of the roll-shaped body 31 is completed, the other side surface of the prism-shaped case body 2 is sealed. Then, another of the holding units 5 and 6 is inserted into the hollow portion of the cylindrical core 32 of the roll-shaped material 31 to complete. At this time, a plastic film sheet with low air permeability and moisture permeability or a sheet having cushioning properties may be wound in advance on an outer periphery of the roll-shaped material 31 as a protecting portion. With the sheet wound, by inserting an excess part of the sheet from a side of an end portion 32E into the hollow portion of the cylindrical core 32, the sheet can easily be held, and the end portion 32E of the cylindrical core 32 can also be protected.

Figure 4:
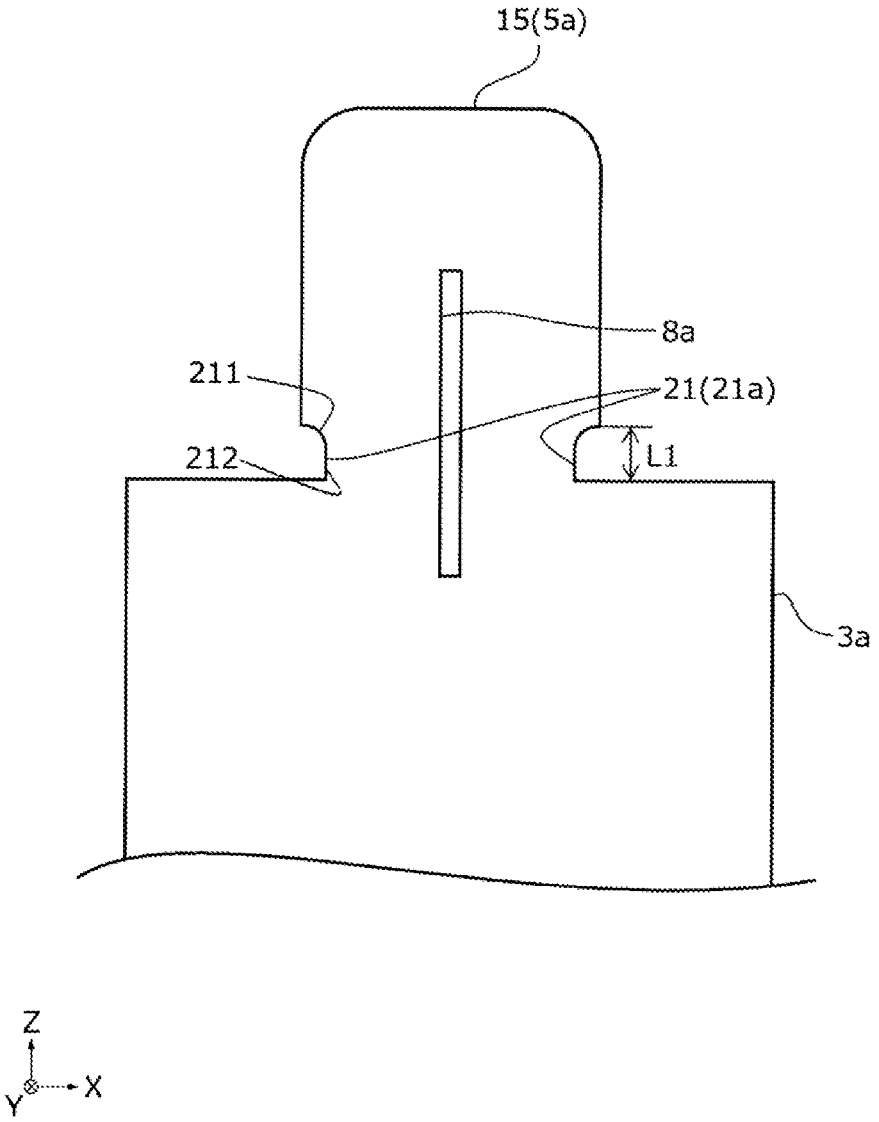
FIG. 4 is a diagram illustrating a first folded portion in the holding unit of the packaging box for the roll-shaped material according to Example 1 of the present disclosure in FIG. 1.
Figure 5:
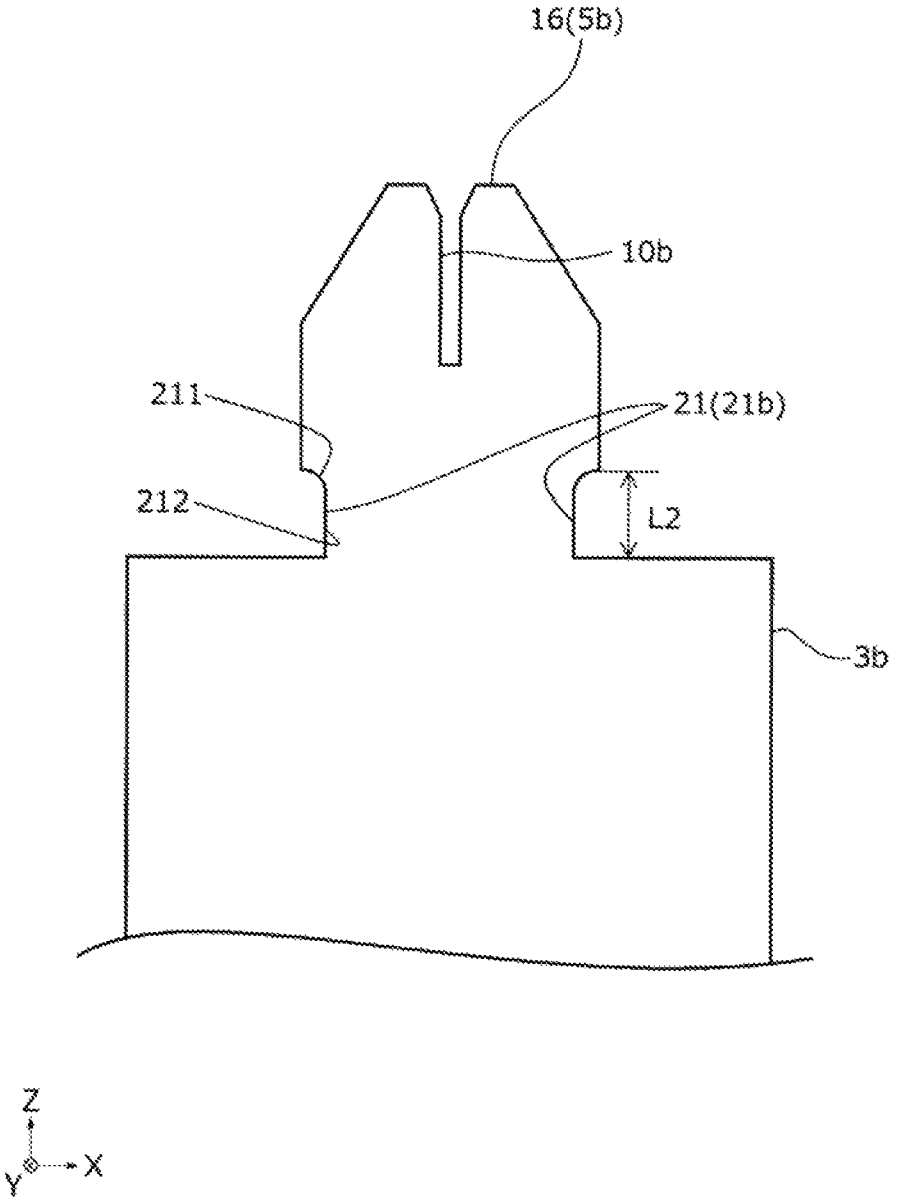
FIG. 5 is a diagram illustrating a second folded portion in the holding unit of the packaging box for the roll-shaped material according to Example 1 of the present disclosure in FIG. 1.

Next, details of the recessed portions 21 and 22 will be described with reference to FIG. 4 and FIG. 5. FIG. 4 is a diagram illustrating a first folded portion 15 corresponding to the holding flaps 5*a*, 5*c*, 6*a*, and 6*c*, and FIG. 5 is a diagram illustrating a second folded portion 16 corresponding to the holding flaps 5*b*, 5*d*, 6*b*, and 6*d*. Here, FIG. 4 is described as the holding flap 5*a*, and FIG. 5 is described as the holding flap 5*b*, but the holding flaps 5*c*, 6*a*, and 6*c* are similarly shaped to the holding flap 5*a*, and the holding flaps 5*d*, 6*b* and 6*d* are similarly shaped to the holding flap 5*b*.

As illustrated in FIG. 1, FIG. 4, and FIG. 5, the recessed portions 21 and 22 are provided in the respective holding units 5 and 6 of the present example. In particular, as illustrated in FIG. 1, two number of the recessed portions are provided in each the holding flap in the cross direction intersecting the longitudinal direction in which the prism-shaped case body 2 extends, such as the recessed portions 21*a* in the holding flap 5*a*, the recessed portions 21*b* in the holding flap 5*b*, the recessed portions 21*c* in the holding flap 5*c*, the recessed portions 21*d* in the holding flap 5*d*, the recessed portions 22*a* in the holding flap 6*a*, the recessed portions 22*b* in the holding flap 6*b*, the recessed portions 22*c* in the holding flap 6*c*, and the recessed portions 22*d* in the holding flap 6*d*. A position at which each of the recessed portions 21 and 22 is formed is a region facing the end portion 32E of the cylindrical core 32 in each of the X-axis direction and the Y-axis direction, when the cylindrical core 32 of the roll-shaped material 31 is inserted into the holding units 5 and 6.

Here, the above descriptions are once summarized as follows: the packaging box 1 of the present example is the packaging box 1 for the roll-shaped material 31 wound around the cylindrical core 32, that includes the prism-shaped case body 2, and the side surface portions 3 and 4 that seal both the side surfaces of the prism-shaped case body 2, and the prism-shaped case body 2 and the and the side surface portions 3 and 4 are formed of the single sheet member. Then, the holding units 5 and 6 are provided that hold the roll-shaped material 31 inside the prism-shaped case body 2, by being inserted into the cylindrical core 32 of the roll-shaped material 31.

In addition, as described above, a region facing the end portion 32E of the cylindrical core 32 in the cross direction intersecting the longitudinal direction in which the prism-shaped case body 2 extends when the holding unit 5 is inserted into the cylindrical core 32 of the roll-shaped material 31, is formed with the recessed portion 21 that is recessed in the cross direction, and a region facing the end portion 32E of the cylindrical core 32 in the cross direction intersecting the longitudinal direction in which the prism-shaped case body 2 extends when the holding unit 6 is inserted into the cylindrical core 32 of the roll-shaped material 31, is formed with the recessed portion 22 that is recessed in the cross direction. Since the packaging box 1 of the present example has the above configuration, the packaging box 1 of the present example can suppress rubbing of the end portion 32E of the cylindrical core 32, and the holding units 5 and 6, and can hold the roll-shaped material 31 without damaging the cylindrical core 32.

Furthermore, as described above, in the packaging box 1 of the present example, the holding units 5 and 6 are integrally formed with the side surface portions 3 and 4 by the single sheet member. As described above, the holding units 5 and 6 are integrally formed with the side surface portions 3 and 4 by the single sheet member, and thus the packaging box 1 of the present example is configured such that the roll-shaped material 31 can be held without separately preparing a holding unit, and without damaging the cylindrical core 32.

In the packaging box 1 of the present example, the prism-shaped case body 2 in the assembled state is the rectangular parallelepiped. Thus, the packaging box 1 of the present example has improved stability when placed on a flat surface.

Also, as illustrated in FIG. 2 and the like, the holding units 5 and 6 are formed, for example, by folding two end portions of the prism-shaped case body 2 that are two opposing surfaces of the cylindrical body 2, such as the holding flap 5*a* and the holding flap 5*c*, inward the prism-shaped case body, and next, for example, fording end portions of the prism-shaped case body 2 that are another two opposing surfaces of the prism-shaped case body 2, such as the holding flap 5*b* and the holding flap 5*d*, inward the prism-shaped case body 2. In another expression, the holding units 5 and 6 of the present example are formed by folding a first surface pair and a second surface pair, that each include end portions of the prism-shaped case body 2 and are two opposing surfaces of the prism-shaped case body 2, inward the prism-shaped case body 2 in order of the first surface pair, and the second surface pair. Here, the first surface pair corresponds to the holding flaps 5*a* and 5*c*, and the holding flaps 6*a* and 6*c*, and the second surface pair corresponds to the holding flaps 5*b* and 5*d*, and the holding flaps 6*b* and 6*d*. In this way, by configuring the holding units 5 and 6 with the first surface pair and the second surface pair, the holding units 5 and 6 can be configured to be simple and robust.

Here, as is apparent from a comparison of FIG. 4 and FIG. 5, a length L2 in the Z-axis direction of the recessed portion 21 of the holding flap 5*b* is larger than a length L1 in the Z-axis direction of the recessed portion 21 of the holding flap 5*a*. In another expression, the length of each of the recessed portions 21 and 22 in the second surface pair in the longitudinal direction in which the prism-shaped case body 2 extends is larger than the length of each of the recessed portions 21 and 22 in the first surface pair in the longitudinal direction in which the prism-shaped case body 2 extends. Since the second surface pair is folded and inserted into the first surface pair that is in the folded state, the second surface pair is positioned on an outer side in the longitudinally direction than the first surface pair, and the length of each of the recessed portions 21 and 22 in the longitudinal direction in the second surface pair that is in the folded state becomes substantially smaller by a thickness of the respective sheet members of the side surface portions 3 and 4 corresponding to the first surface pair. Thus, when the length of each of the recessed portion 21 and 22 in the longitudinal direction in the second surface pair is too small, there is a possibility that the end portion 32E of the cylindrical core 32 contacts the second surface pair. However, by making the length of each of the recessed portions 21 and 22 in the longitudinal direction in the second surface pair longer than the length of each of the recessed portions 21 and 22 in the longitudinal direction in the first surface pair, each of the recessed portions 21 and 22 in the second surface pair can be shaped in consideration of the thickness of the sheet member corresponding to the first folded portion 15 configuring the first surface pair. That is, contact between the second surface pair and the end portion 32E of the cylindrical core 32, caused by the length of each of the recessed portions 21 and 22 in the longitudinal direction in the second surface pair becoming insufficient, caused by an increase in the thickness of the sheet member corresponding to the first folded portion 15 configuring the first surface pair, can be suppressed. From the above, the length of each of the recessed portions 21 and 22 in the longitudinal direction in the second surface pair may be equal to or larger than the thickness of the sheet member corresponding to the first folded portion 15 configuring the first surface pair, and larger than the length of each of the recessed portions 21 and 22 in the longitudinal direction in the first surface pair.

Additionally, as illustrated in FIG. 4 and FIG. 5, each of the recessed portions 21 and 22 is configured by combining a straight line portion 212 and an arc portion 211. When each of the recessed portions 21 and 22 is formed by only a straight line portion 212, strength may decrease at a corner portion where the straight line portion 212 intersects or the like, and when each of the recessed portions 21 and 22 is formed by only the arc portion 211, adjustments of an recessed amount of each of the recessed portions 21 and 22 may be difficult, but by combining the straight line portion 212 and the arc portion 211 to form each of the recessed portions 21 and 22, such adverse effects can be suppressed. However, each of the recessed portions 21 and 22 may be configured only by the straight line portion 212 or the arc portion 211.

Here, the lengths L1 and L2 in the Z-axis direction of the recessed portions 21 and 22 may be equal to or larger than 5 mm and equal to or less than 50 mm. Because, when the lengths L1 and L2 of the recessed portions 21 and 22 in the Z-axis direction are too small, the end portion 32E of the cylindrical core 32 and the holding units 5 and 6 may contact and damage the cylindrical core 32, and when the lengths L1 and L2 of the recessed portions 21 and 22 in the Z-axis direction are too large, strength of the holding units 5 and 6 may decrease. By setting the lengths L1 and L2 of the recessed portions 21 and 22 in the Z-axis direction to be equal to or larger than 5 mm and equal to or less than 50 mm, such adverse effects can be suppressed. Note that, particularly, the lengths L1 and L2 of the recessed portions 21 and 22 in the Z-axis direction may be equal to or larger than 20 mm, and particularly, may be equal to or less than 30 mm.

In addition, the sheet member of the packaging box 1 of the present example is formed of cardboard, but as in the sheet member of the packaging box 1 of the present example, the sheet member may be formed of cardboard or coated cardboard. This is because the prism-shaped case body 2 and the side surface portions 3 and 4 can be configured to be robust and lightweight. Also, for example, by forming the holding units 5 and 6 of cardboard or coated cardboard, the holding units 5 and 6 can also be formed to be robust and lightweight. However, the present disclosure is not limited to such a configuration, and the sheet member may be formed of pasteboard, a resin member, or the like.

Example 2

Next, the packaging box 1 according to Example 2 will be described, with reference to FIG. 6 and FIG. 7. Note that, in FIG. 6 and FIG. 7, the constituent members common to those in Example 1 described above are denoted by the same reference numerals, and the detailed description will be omitted. Here, the suspending members 25 and 26, as the holding units of the present example, have respective shapes similar to each other.

Figure 6:
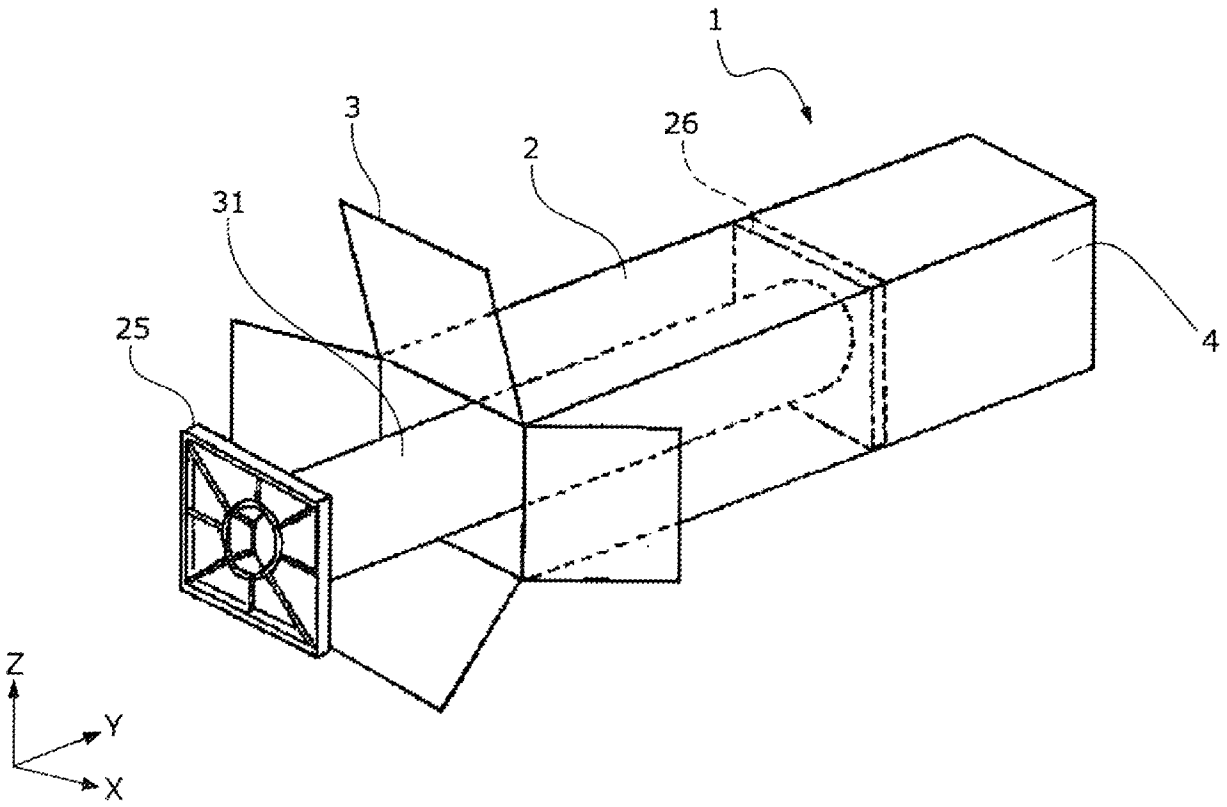
FIG. 6 is a perspective view of a packaging box for a roll-shaped material according to Example 2 of the present disclosure.
Figure 7:
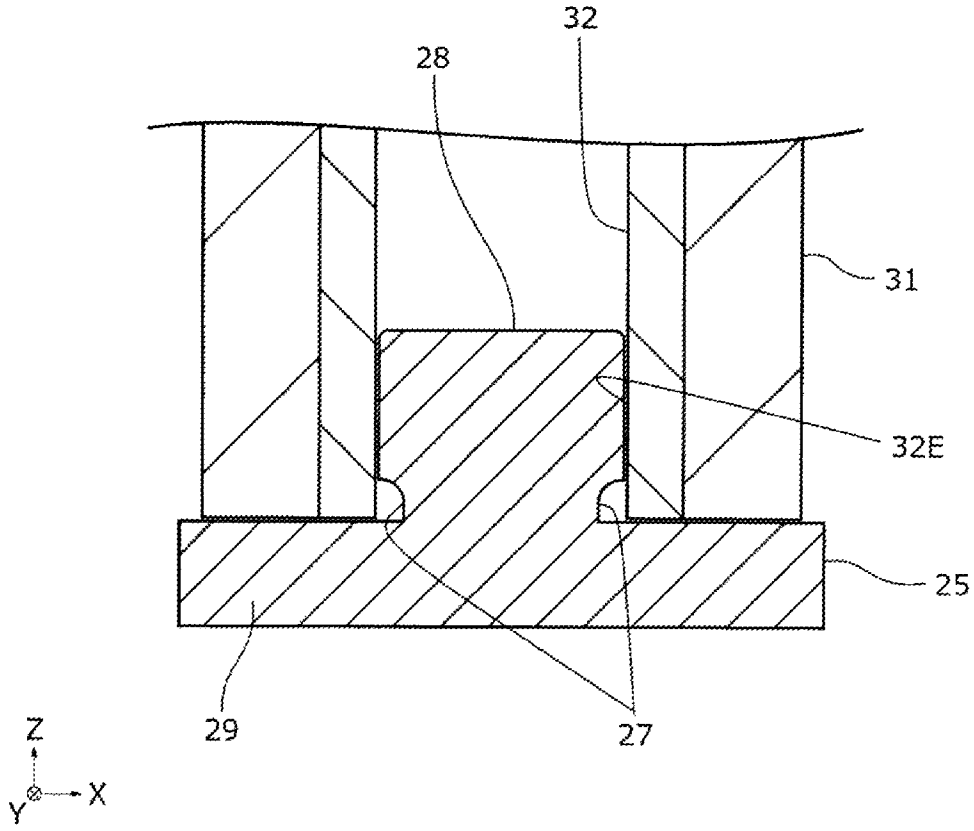
FIG. 7 is a cross-sectional view of a holding unit in the packaging box for the roll-shaped material according to Example 2 of the present disclosure.

As illustrated in FIG. 6, the packaging box 1 of the present example, is not provided with the holding units 5 and 6 integral with the respective side surface portions 3 and 4, instead, is provided with the suspending members 25 and 26 that are separate bodies from the side surface portions 3 and 4. As illustrated in FIG. 7, each of the suspending members 25 and 26 includes an insertion portion 28 inserted into the cylindrical core 32 at the end portion 32E, and a flange portion 29 in contact with the roll-shaped material 31 and the cylindrical core 32 from an outside in the Z-axis direction. In addition, a recessed portion 27 is formed in a region on a side of the flange portion 29 of the insertion part 28, that is a region facing the end portion 32E of the cylindrical core 32 in the X-axis direction and the Y-axis direction, when the suspending members 25 and 26 are inserted into the cylindrical core 32 of the roll-shaped material 31.

In other words, in the packaging box 1 of the present example, the holding unit is formed as a separate body from the sheet member configuring the prism-shaped case body 2 and the side surface portions 3 and 4. For this reason, the holding unit and the sheet member can each be configured by an optimal material.

the present disclosure is not limited to the present examples described above, and can be realized in various configurations without departing from the gist of the present disclosure. For example, appropriate replacements or combinations may be made to the technical features in the present embodiments which correspond to the technical features in the aspects described in the SUMMARY section to solve some or all of the problems described above or to achieve some or all of the advantageous effects described above. Additionally, when the technical features are not described herein as essential technical features, such technical features may be deleted appropriately.

What is claimed is:

1. A packaging box for a roll-shaped material wound around a cylindrical core, including a prism-shaped case body, and a plurality of side surface portions at both ends in a longitudinal direction of the prism-shaped case body, the prism-shaped case body and each side surface portion being formed of a single sheet member, the packaging box for the roll-shaped material, comprising:

a holding unit configured to be inserted into the cylindrical core of the roll-shaped material to hold the roll-shaped material within the prism-shaped case body, wherein:

the holding unit comprises a plurality of holding unit portions, each of which is connected to one of the plurality of side surface portions, each of the plurality of holding unit portions comprises a recess portion disposed next to the side surface portion that is connected thereto, causing the holding unit to have a recessed portion to suppress rubbing between an end portion of the cylindrical core and the holding unit, and when the holding unit is inserted into the cylindrical core of the roll-shaped material, a region facing an end portion of the cylindrical core in a cross direction intersecting the longitudinal direction, is formed with the recessed portion that is recessed in the cross direction.

2. The packaging box for the roll-shaped material according to claim 1, wherein the holding unit is integrally formed with the side surface portion by the single sheet member.

3. The packaging box for the roll-shaped material according to claim 2, wherein the prism-shaped case body is a rectangular parallelepiped, the holding unit is formed by folding a first pair of holding unit portions and a second pair of holding unit portions, each of the first pair or the second pair including opposing two holding unit portions, and a length of the recessed portion in the longitudinal direction in the second pair is larger than a length of the recessed portion in the longitudinal direction in the first pair.

4. The packaging box for the roll-shaped material according to claim 1, wherein the recessed portion is formed by combining a straight line portion and an arc portion.

5. The packaging box for the roll-shaped material according to claim 1, wherein the sheet member is formed of cardboard or coated cardboard.

6. The packaging box for the roll-shaped material according to claim 1, wherein the length of the recessed portion in the longitudinal direction is equal to or less than 50 mm.

7. A packaging material for a roll-shaped material wound around a cylindrical core, comprising:

a packaging box includes a prism-shaped case body and respective side surface portions at both ends in a longitudinal direction of the prism-shaped case body, and a holding unit configured to hold the roll-shaped material within the package box, wherein;

the holding unit is formed as a different body from the packaging box, the holding unit includes an insertion portion configured to be inserted into the cylindrical core at an end portion of the cylindrical core and a flange portion configured to be in contact with the cylindrical core from an outside in a longitudinal direction, the insertion portion comprises a recess portion disposed next to the flange portion that is connected thereto, when the insertion portion is inserted into the cylindrical core of the roll-shaped material, a region facing an end portion of the cylindrical core in a cross direction intersecting the longitudinal direction, is formed with a recessed portion that is recessed in the cross direction to suppress rubbing between an end portion of the cylindrical core and the holding unit.

8. The packaging material for the roll-shaped material according to claim 7, wherein the recessed portion is formed by combining a straight line portion and an arc portion.

9. The packaging material for the roll-shaped material according to claim 7, wherein the packaging box is formed of a single sheet member and the sheet member is formed of cardboard or coated cardboard.

10. The packaging material for the roll-shaped material according to claim 7, wherein the holding unit is formed of a single sheet member and the sheet member is formed of cardboard or coated cardboard.

11. The packaging material for the roll-shaped material according to claim 7, wherein the length of the recessed portion in the longitudinal direction is equal to or less than 50 mm.

12. The packaging material for the roll-shaped material according to claim 7, wherein the prism-shaped case body is a rectangular parallelepiped, the holding unit is formed by folding a first pair of holding unit portions and a second pair of holding unit portions, each of the first pair or the second pair including opposing two holding unit portions, and a length of the recessed portion in the longitudinal direction in the second pair is larger than a length of the recessed portion in the longitudinal direction in the first pair.

13. A packaging box for a roll-shaped material wound around a cylindrical core, including a prism-shaped case body, and a plurality of side surface portions at both ends in a longitudinal direction of the prism-shaped case body, the prism-shaped case body and each side surface portion being formed of a single sheet member, the packaging box for the roll-shaped material, comprising:

a holding unit configured to be inserted into the cylindrical core of the roll-shaped material to hold the roll-shaped material within the prism-shaped case body, wherein:

the holding unit comprises a first pair of holding unit portions and a second pair of holding unit portions, the first pair of holding unit portions are two opposing holding unit portions, and are connected to one of the plurality of side surface portions, the second pair of holding unit portions are two opposing holding unit portions, and are connected to one of the plurality of side surface portions, the holding unit is formed by folding the first pair of holding unit portions and the second pair of holding unit portions, each of the two opposing holding unit portions of the first pair of holding unit portions and each of the two opposing holding unit portions of the second pair of holding unit portions comprises a recess portion disposed next to the side surface portion that is connected thereto.

* * * * *